US012359131B2

(12) United States Patent
Bengier

(10) Patent No.: US 12,359,131 B2
(45) Date of Patent: Jul. 15, 2025

(54) BIOMASS REACTOR

(71) Applicant: Clean Carbon Reactor, LLC, McKeesport, PA (US)

(72) Inventor: Edward J. Bengier, Steubenville, OH (US)

(73) Assignee: Clean Carbon Reactor, LLC, McKeesport, PA (US)

( * ) Notice: Subject to any disclaimer, the term of this patent is extended or adjusted under 35 U.S.C. 154(b) by 300 days.

(21) Appl. No.: 18/127,068

(22) Filed: Mar. 28, 2023

(65) Prior Publication Data

US 2024/0327714 A1 Oct. 3, 2024

(51) Int. Cl.
*C10B 53/02* (2006.01)

(52) U.S. Cl.
CPC ..... *C10B 53/02* (2013.01); *C10G 2300/1011* (2013.01)

(58) Field of Classification Search
CPC ..... C10B 53/02; C10B 47/12; C10B 47/32; C10G 2300/1011; C10G 1/02; C10K 1/04
See application file for complete search history.

(56) References Cited

U.S. PATENT DOCUMENTS 9,211,515 B2 * 12/2015 Fink ..... B01J 8/002
9,713,908 B2 * 7/2017 Shaffer ..... B30B 9/065
2010/0116267 A1 * 5/2010 Mraz ..... C08B 37/0057 127/1
2010/0133086 A1 * 6/2010 Kawami ..... C10L 5/44 202/96
2010/0205860 A1 * 8/2010 Kawami ..... C10L 5/44 422/208
2010/0285574 A1 * 11/2010 Genta ..... C10G 1/047 127/36
2011/0048918 A1 * 3/2011 Strezov ..... C10B 53/02 34/498
2011/0212012 A1 * 9/2011 McAlister ..... C10J 3/10 423/437.1
2011/0290788 A1 * 12/2011 Klemarewski ..... C10L 9/083 219/678
2012/0058544 A1 * 3/2012 Genta ..... B08B 1/32 435/290.1
2013/0172636 A1 * 7/2013 McAlister ..... C12P 5/023 423/437.1
2014/0003968 A1 * 1/2014 Gros-D'Aillon ..... F04B 15/023 417/442
2014/0110242 A1 * 4/2014 Pehota ..... C10B 7/00 202/117

(Continued)

*Primary Examiner* — Ali Z Fadhel
(74) *Attorney, Agent, or Firm* — The Webb Law Firm

(57) ABSTRACT

An apparatus for production of a carbon product from a biomass source, the apparatus including a reactor having a hollow body configured to receive the biomass source therein. The hollow body has a proximal end with an entry opening and a distal end with an exit opening, and a load zone between the proximal end and the distal end. The apparatus further includes an entry mover at the proximal end of the hollow body and movable between the proximal end and the distal end, and an exit mover within the hollow body positioned distal to the entry mover. The apparatus further includes at least one heating element configured to heat at least one heating zone of the hollow body. A method of producing a carbon product from a biomass source is also disclosed.

20 Claims, 4 Drawing Sheets

(56) References Cited

U.S. PATENT DOCUMENTS

| | | | | |
|---|---|---|---|---|
| 2014/0311883 | A1* | 10/2014 | Strezov | C10B 7/00 201/20 |
| 2016/0017233 | A1* | 1/2016 | Mathis | C01B 32/318 201/37 |
| 2016/0144351 | A1* | 5/2016 | Boldor | B01J 23/40 201/2.5 |
| 2016/0334160 | A1* | 11/2016 | Pallmann | B30B 9/06 |
| 2017/0233327 | A1* | 8/2017 | Johannsen | C07D 307/34 549/505 |
| 2021/0069609 | A1* | 3/2021 | Fuchs | B01D 11/0265 |
| 2021/0347720 | A1* | 11/2021 | Johannsen | C10G 3/40 |
| 2022/0363994 | A1* | 11/2022 | Besong | C10K 1/024 |

* cited by examiner

BIOMASS REACTOR

BACKGROUND

Technical Field

The present disclosure relates generally to systems and methods for processing biomass such that the process is continuous, environment-friendly, and more efficient.

Technical Considerations

Waste may be processed to capture the carbon contained within the waste to be recycled. One method of obtaining carbon from waste is pyrolysis. Pyrolysis uses heat to release carbon from waste without the use of oxygen, which results in significantly less carbon dioxide production compared to using heat in the presence of oxygen. However, pyrolysis nevertheless produces carbon dioxide, the production of which depends on the specific contents of the waste.

Accordingly, there is a need in the art for an improved system and methods for processing waste to capture carbon that result in limited carbon dioxide production regardless of the waste that is processed.

SUMMARY

According to some non-limiting embodiments or aspects, provided is an apparatus for production of a carbon product from a biomass source, the apparatus comprising: a reactor comprising a hollow body configured to receive the biomass source therein, the hollow body having a proximal end with an entry opening and a distal end with an exit opening, and a load zone between the proximal end and the distal end; an entry mover at the proximal end of the hollow body and movable between the proximal end and the distal end; an exit mover within the hollow body positioned distal to the entry mover; and at least one heating element, the at least one heating element configured to heat at least one heating zone of the hollow body, wherein the load zone is defined by a space within the hollow body between the entry mover and the exit mover, wherein the reactor continually receives the biomass source while the at least one heating element is heating a portion of the biomass source.

In some non-limiting embodiments or aspects, the apparatus may further comprise an offtake system having at least one offtake pipe and at least one tunnel head, the offtake system configured to receive gas from the hollow body of the reactor. The at least one tunnel head may be configured to offtake gas produced during production of the carbon product from within the hollow body of the reactor. The at least one offtake pipe may be in fluid communication with the tunnel head, the at least one offtake pipe configured to receive gas from the tunnel head.

In some non-limiting embodiments or aspects, the apparatus may further comprise a decanter system having at least one liquor pipe, at least one liquor spray, and a decanter tank, wherein the decanter system is configured to cool the gas received by an offtake system. The at least one liquor pipe having a proximal end may be in fluid communication with a decanter tank and a distal end in fluid communication with at least one offtake pipe. The at least one liquor spray may be connected to the proximal end of the at least one liquor pipe. The at least one liquor spray may be configured to spray liquor from the decanter tank into at least one offtake pipe.

In some non-limiting embodiments or aspects, the apparatus may further comprise a gas collection system having at least one exhauster pump, at least one exit gas pipe, and at least one gas main. The at least one exhauster pump may facilitate gas flow from a decanter system into the at least one gas main, wherein the at least one gas main is in fluid communication with the at least one heating element. The at least one exit gas pipe may facilitate gas flow out from the decanter system and/or an offtake system.

In some non-limiting embodiments or aspects, the apparatus may further comprise a loading chute configured to introduce the biomass source to the load zone. The apparatus may further comprise at least one temperature measuring device, the at least one temperature measuring device configured to measure temperature within the at least one heating zone. The apparatus may further comprise a shield surrounding the hollow body of the reactor and the at least one heating element. The apparatus may further comprise an entry hydraulic unit configured for moving the entry mover; and an exit hydraulic unit configured for moving the exit mover, wherein the entry mover and the exit mover move in unison within the hollow body of the reactor.

According to some non-limiting embodiments or aspects, provided is a method of producing a carbon product from a biomass source, the method comprising: introducing a first load of the biomass source to a load zone of a reactor; compacting the first load of the biomass source to a first predetermined size; preheating a plurality of heating zones to a first predetermined temperature; pushing the biomass source to a first heating zone of the plurality of heating zones; heating the first heating zone of the plurality of heating zones to a second predetermined temperature; introducing a second load of the biomass source to the load zone; compacting the first load of the biomass source and the second load of the biomass source to a second predetermined size; pushing the second load of the biomass source to the first heating zone and pushing the first load of the biomass source to a second heating zone of the plurality of heating zones; and heating the second heating zone to a third predetermined temperature.

In some non-limiting embodiments or aspects, the method may further comprise measuring a temperature of the first load of the biomass source or the second load of the biomass source. The method may further comprise collecting gas generated from the biomass source from the plurality of heating zones. The method may further comprise cooling the gas collected from the plurality of heating zones; and collecting liquefied carbon from the collected gas, wherein the liquefied carbon comprises tar. The method may further comprise pushing the first load of the biomass source from the second heating zone of the plurality of heating zones to a collection zone; and treating the biomass source with nitrogen.

Further, non-limiting embodiments or aspects are set forth in the following numbered clauses.

Clause 1: An apparatus for production of a carbon product from a biomass source, the apparatus comprising: a reactor comprising a hollow body configured to receive the biomass source therein, the hollow body having a proximal end with an entry opening and a distal end with an exit opening, and a load zone between the proximal end and the distal end; an entry mover at the proximal end of the hollow body and movable between the proximal end and the distal end; an exit mover within the hollow body positioned distal to the entry mover; and at least one heating element, the at least one heating element configured to heat at least one heating zone of the hollow body, wherein the load zone is defined by a space within the hollow body between the entry mover and the exit mover, wherein the reactor continually receives the biomass source while the at least one heating element is heating a portion of the biomass source.

Clause 2: The apparatus of clause 1, further comprising an offtake system having at least one offtake pipe and at least one tunnel head, the offtake system configured to receive gas from the hollow body of the reactor.

Clause 3. The apparatus of clause 1 or 2, wherein the at least one tunnel head is configured to offtake gas produced during production of the carbon product from within the hollow body of the reactor.

Clause 4: The apparatus of any of clauses 1-3, wherein the at least one offtake pipe is in fluid communication with the tunnel head, the at least one offtake pipe configured to receive gas from the tunnel head.

Clause 5: The apparatus of any of clauses 1-4, further comprising a decanter system having at least one liquor pipe, at least one liquor spray, and a decanter tank, wherein the decanter system is configured to cool the gas received by an offtake system.

Clause 6: The apparatus of any of clauses 1-5, wherein the at least one liquor pipe having a proximal end is in fluid communication with a decanter tank and a distal end in fluid communication with at least one offtake pipe.

Clause 7: The apparatus of any of clauses 1-6, wherein the at least one liquor spray is connected to the proximal end of the at least one liquor pipe.

Clause 8: The apparatus of any of clauses 1-7, wherein the at least one liquor spray is configured to spray liquor from the decanter tank into at least one offtake pipe.

Clause 9: The apparatus of any of clauses 1-8, further comprising a gas collection system having at least one exhauster pump, at least one exit gas pipe, and at least one gas main.

Clause 10: The apparatus of any of clauses 1-9, wherein the at least one exhauster pump facilitates gas flow from a decanter system into the at least one gas main, wherein the at least one gas main is in fluid communication with the at least one heating element.

Clause 11: The apparatus of any of clauses 1-10, wherein the at least one exit gas pipe facilitates gas flow out from the decanter system and/or an offtake system.

Clause 12: The apparatus of any of clauses 1-11, further comprising a loading chute configured to introduce the biomass source to the load zone.

Clause 13: The apparatus of any of clauses 1-12, further comprising at least one temperature measuring device, the at least one temperature measuring device configured to measure temperature within the at least one heating zone.

Clause 14: The apparatus of any of clauses 1-13, further comprising a shield surrounding the hollow body of the reactor and the at least one heating element.

Clause 15: The apparatus of any of clauses 1-14, further comprising an entry hydraulic unit configured for moving the entry mover; and an exit hydraulic unit configured for moving the exit mover, wherein the entry mover and the exit mover move in unison within the hollow body of the reactor.

Clause 16: A method of producing a carbon product from a biomass source, the method comprising: introducing a first load of the biomass source to a load zone of a reactor; compacting the first load of the biomass source to a first predetermined size; preheating a plurality of heating zones to a first predetermined temperature; pushing the biomass source to a first heating zone of the plurality of heating zones; heating the first heating zone of the plurality of heating zones to a second predetermined temperature; introducing a second load of the biomass source to the load zone; compacting the first load of the biomass source and the second load of the biomass source to a second predetermined size; pushing the second load of the biomass source to the first heating zone and pushing the first load of the biomass source to a second heating zone of the plurality of heating zones; and heating the second heating zone to a third predetermined temperature.

Clause 17: The method of clause 16, further comprising measuring a temperature of the first load of the biomass source or the second load of the biomass source.

Clause 18: The method of clause 16 or 17, further comprising collecting gas generated from the biomass source from the plurality of heating zones.

Clause 19: The method of any of clauses 16-18, further comprising cooling the gas collected from the plurality of heating zones; and collecting liquefied carbon from the collected gas, wherein the liquefied carbon comprises tar.

Clause 20: The method of any of clauses 16-19, further comprising pushing the first load of the biomass source from the second heating zone of the plurality of heating zones to a collection zone; and treating the biomass source with nitrogen.

These and other features and characteristics of the present disclosure, as well as the methods of operation and functions of the related elements of structures and the combination of parts and economics of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

DETAILED DESCRIPTION

Figure 1:
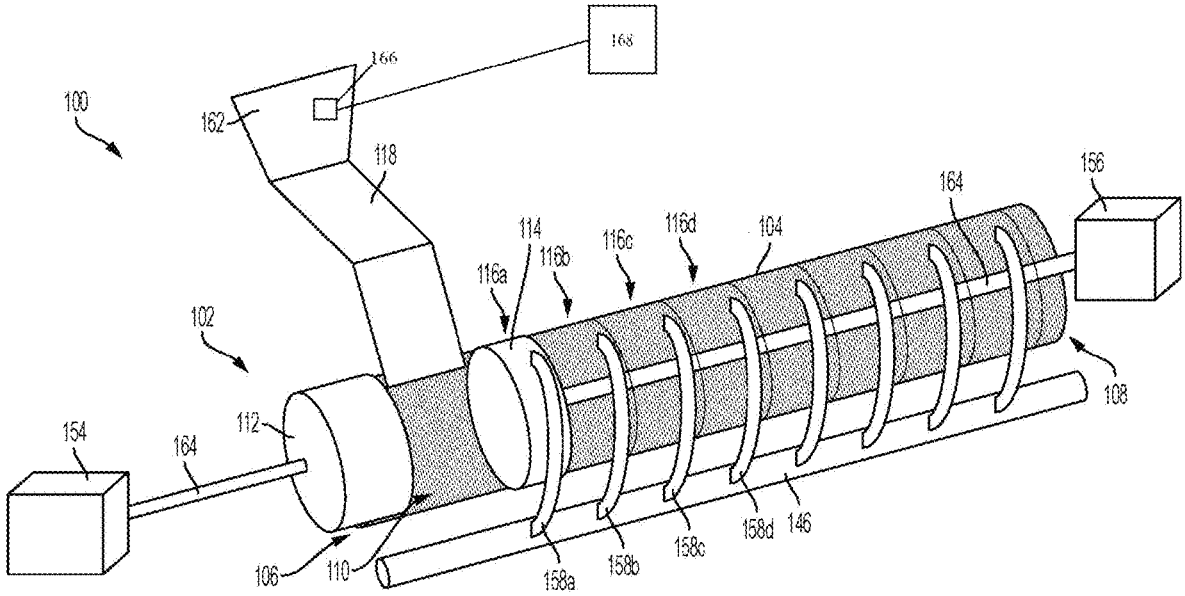
FIG. 1 is a schematic view of a biomass reactor according to some non-limiting embodiments or aspects of the present disclosure.

As used herein, the singular form of "a", "an", and "the" include plural referents unless the context clearly dictates otherwise. Spatial or directional terms, such as "left", "right", "inner", "outer", "above". "below", and the like, relate to the embodiments or aspects as shown in the drawing figures and are not to be considered as limiting as the embodiments or aspects can assume various alternative orientations. All numbers used in the specification and claims are to be understood as being modified in all instances by the term "about" or "approximately". By "about" or "approximately" is meant within plus or minus twenty-five percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements. All documents referred to herein are "incorporated by reference" in their entirety. The term "at least" is synonymous with "greater than or equal to".

As used herein, "at least one of" is synonymous with "one or more of". For example, the phrase "at least one of A, B, or C" means any one of A, B, or C, or any combination of any two or more of A, B, or C. For example, "at least one of A, B, and C" includes A alone; or B alone; or C alone; or A and B; or A and C; or B and C; or all of A, B, and C. The word "comprising" and "comprises", and the like, does not exclude the presence of elements or steps other than those listed in any claim or the specification as a whole. In the present specification, "comprises" means "includes" and "comprising" means "including".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values. As used herein, the terms "perpendicular", "transverse", "substantially perpendicular", or "substantially transverse" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

The discussion of various embodiments or aspects may describe certain features as being "particularly" or "preferably" within certain limitations (e.g., "preferably", "more preferably", or "even more preferably", within certain limitations). It is to be understood that the disclosure is not limited to these particular or preferred limitations but encompasses the entire scope of the various embodiments and aspects described herein. The disclosure comprises, consists of, or consists essentially of, the following embodiments or aspects, in any combination. Various embodiments or aspects of the disclosure are illustrated in separate drawing figures. However, it is to be understood that this is simply for case of illustration and discussion. In the practice of the disclosure, one or more embodiments or aspects shown in one drawing figure can be combined with one or more embodiments or aspects shown in one or more of the other drawing figures.

In some non-limiting embodiments or aspects, and with initial reference to FIG. 1, the apparatus 100 may include a reactor 102. The reactor 102 may define a hollow body 104, an entry opening 106, an exit opening 108, and a load zone 110. The hollow body 104 may be of any dimension, such as circular, rectangular, trigonal, etc. The hollow body 104 may vary in dimension and size. The dimension and size of the entry opening 106, the exit opening 108, and the hollow body 104 may be identical. For instance, the hollow body 104, the entry opening 106, and the exit opening 108 may have a shape of a circle, such that the reactor 102 may be formed as a cylinder. The hollow body's 104 circumference and the length may vary. The reactor 102 may be configured to receive a biomass source 162. For example, the biomass source 162 may be received at the load zone 110.

In some non-limiting embodiments or aspects, and with continued reference to FIG. 1, the apparatus 100 may include an entry mover 112. The entry mover 112 may be of any suitable shape and size. For example, the entry mover 112 may be a structure that is received within the interior of the reactor 102. The entry mover 112 may be a piston head that is configured to move within the reactor 102 by an entry hydraulic unit 154. For example, the entry mover 112 may conform to the dimensions of the reactor 102 such that the entry mover 112 may move within the hollow body 104 of the reactor 102. The entry mover 112 may move from the entry opening 106 of the reactor 102 to the exit opening 108 of the reactor 102. The entry mover 112 may be moved outside of the reactor 102. For instance, the entry mover 112 may be placed outside of the reactor 102 and moved into the reactor 102 through the entry opening 106. Further, the entry mover 112 may move and exit the reactor 102 by going past the exit opening 108. The apparatus 100 may include the entry hydraulic unit 154 and one or more hydraulic cylinders 164 that are configured to move the entry mover 112. It is to be understood that the one or more hydraulic cylinders 164 may vary in size and shape.

In some non-limiting embodiments or aspects, and with continued reference to FIG. 1, the apparatus 100 may include an exit mover 114. The exit mover 114 may be of any suitable shape and size. For example, the exit mover 114 may be a structure that is received within the interior of the reactor 102. The exit mover 114 may be a piston head that is configured to move within the reactor 102 by an exit hydraulic unit 156. For example, the exit mover 114 may conform to the dimension of the reactor 102 such that the exit mover 114 may move within the hollow body 104 of the reactor. The exit mover 114 may move from the exit opening 108 of the reactor 102 to the entry opening 106 of the reactor 102. The exit mover 114 may be moved outside of the reactor 102. For instance, the exit mover 114 may be placed outside of the reactor 102 and moved into the reactor 104 through the exit opening 108. Further the exit mover 114 may move and exit the reactor 102 by going past the entry opening 106. The apparatus 100 may include an exit hydraulic unit 156 and one or more hydraulic cylinders 164 that are configured to move the exit mover 114. It is to be understood that the one or more hydraulic cylinders 164 may vary in size and shape.

In some non-limiting embodiments or aspects, and with continued reference to FIG. 1, the reactor 102 may define one or more heating zones 116. For the purpose of illustration, four heating zones are depicted in FIG. 1 as **116*a*-116*d*. The reactor may define more than four heating zones. The heating zones may be equal or differ in size and dimension. For example, the dimensions of the heating zones 116*a*-116*d* may be identical. Alternatively, the dimensions of each of the heating zones 116*a*-116*d*** may differ.

In some non-limiting embodiments or aspects, and with continued reference to FIG. 1, the entry mover 112 and the exit mover 114 may move in unison or independent of each other. For instance, the entry mover 112 and the exit mover 114 move in unison such that a space defined by the distance between the entry mover 112 and the exit mover 114 remain constant. Referring to FIG. 1, the entry mover 112 and the exit mover 114 are in their initial positions, in which the distance between the entry mover 112 and the exit mover 114 defines the load zone 110. While the entry mover 112 and the exit mover 114 are in their initial positions, a first portion of the biomass source 162 is received within the load zone 110, the entry mover 112 and/or the exit mover 114 may move proximally and/or distally within the reactor 102 in order to compact the first portion of the biomass source 162 within the load zone 110. After a sufficient amount of the first portion of the biomass source 162 is received and compacted, the entry mover 112 and the exit mover 114 may move in unison such that the first portion of the biomass source 162 is moved into the first heating zone 116*a* of the reactor 102. Biomass source 162 is compacted such that air within the biomass source 162 is forced out and air cannot get into the compacted biomass source. Such compacted biomass source 162 allows pyrolysis by limiting the access of oxygen.

In some non-limiting embodiments or aspects, and with continued reference to FIG. 1, after the first portion of the biomass source 162 is moved to the first heating zone 116*a*, the entry mover 112 may move to its initial position. This allows a second portion of the biomass source 162 to be received in the load zone 110 of the reactor. In this instance, the load zone 110 is defined by space between the compacted first portion of the biomass source 162 located in the first heating zone 116*a* and the entry mover 112. As a second portion of the biomass source 162 is received at the load zone 110, the entry mover 112 and/or the exit mover 114 may move to compact the second portion of the biomass source 162 within the load zone 110. After the second portion of the biomass source 162 is compacted, the entry mover 112 and the exit mover 114 move in unison such that the second portion of the biomass source 162 is moved into the first heating zone 116*a* and the first portion of the biomass source 162 is moved into the second heating zone 116*b*. The same process may repeat such that the biomass source 162 is continuously received at the load zone 110 and moved within the reactor 102 such that the subsequent biomass source 162 is moved to the first heating zone 116*a*, to the second heating zone 116*b*, to the third heating zone 116*c*, to the fourth heating zone 116*d*, etc. until the biomass source 162 exits the reactor 102 at the exit opening 108.

In some non-limiting embodiments or aspects, and with continued reference to FIG. 1, the apparatus 100 may include one or more heating elements 158. For the purpose of illustration, FIG. 1 depicts eight heating elements 158 and four heating elements are labeled 158*a*-158*d*; however, it is appreciated that the apparatus 100 may include any number of heating elements 158. Each of the heating elements 158 may be placed near one heating zone 116. For instance, the first heating element 158*a* may be placed near the first heating zone 116*a* to provide heat to the first heating zone 116*a*, the second heating element 158*b* may be placed near the second heating zone 116*b* to provide heat to the second heating zone 116*b*, and so on. Each of the heating elements 158 may provide varying heat to the heating zones 116. The apparatus 100 may include a gas main that provides fuel to each of the heating elements 158. More than one heating element 158 may provide varying heat to each of the heating zones 116. For example, each of the heating zones may have different numbers of heating elements 158 placed near the heating zones.

In some non-limiting embodiments or aspects, and with continued reference to FIG. 1, the apparatus 100 may include a loading chute 118. The biomass source 162 may be placed within the loading chute 118. The loading chute 118 may be configured to control the amount of biomass source 162 that is introduced into the load zone 110 of the reactor 102.

In some non-limiting embodiments or aspects, and with continued reference to FIG. 1, the apparatus 100 may include at least one sensor 166 and a controller 168. The at least one sensor 166 and the controller 168 may be configured for one- or two-way communication. The communication may be wired or wireless. The controller 168 may be configured to control operation of the apparatus 100, such as movement of the entry mover 112 and the exit mover 114, temperatures of the heating elements 158, loading of biomass source in the load zone 110 via the loading chute 118, the time the biomass source 162 is heated within each of the heating zones 116, the movement and time the temperature measuring devices measure the biomass source, the gas collection system 140, and the decanter system 130. The at least one sensor 166 may determine a plurality of aspects of the biomass source 162, such as volume, weight, and content. The biomass source 162 may be of any material containing carbon to include, but not limited to, railroad ties, recover creosote, wood, garbage, plastic, etc. The at least one sensor 166 may be placed in any suitable area of the apparatus for determining the plurality of aspects of the biomass source 162. For example, the at least one sensor 166 may be placed near the loading chute 118. Depending on the plurality of aspects of the biomass source 162, the controller 168 may determine a specific amount of biomass source 162 introduced into the load zone 110, compacted by the entry mover 112 and the exit mover 114, and heated throughout the reactor 102, as well as the time and temperature of the heating zones, in which the biomass source 162 is heated.

Figure 2:
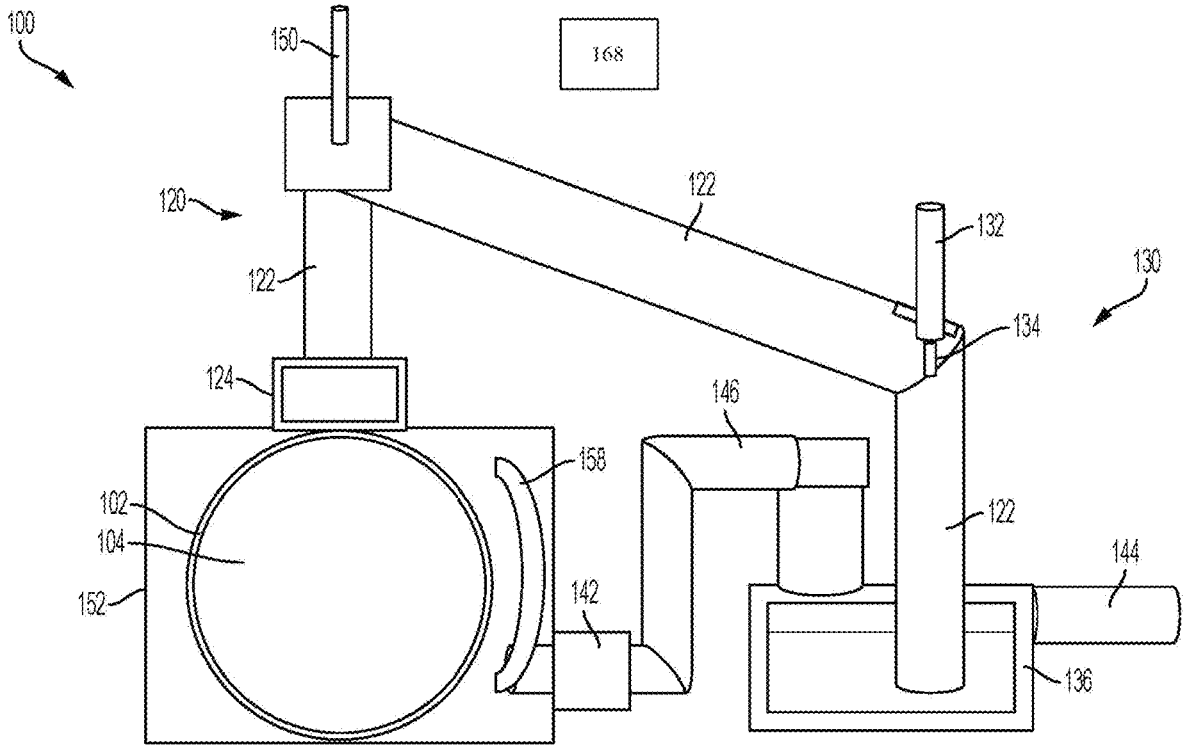
FIG. 2 is a cross-sectional view of the biomass reactor of FIG. 1.

In some non-limiting embodiments or aspects, and with reference to FIG. 2, the apparatus 100 may include a shield 152. The shield 152 may surround the reactor 102 and the one or more heating elements 158. The shield 152 may retain the heat produced by the one or more heating elements 158 around the reactor 102 such that less energy is needed to reach the desired heat of the one or more heating zones 116. The shield 152 may be of any size and shape suitable to surround the one or more heating elements 158 and the reactor 102. The shield 152 may be made of any material suitable for insulating high heat.

In some non-limiting embodiments or aspects, and with continued reference to FIG. 2, the apparatus 100 may include at least one temperature measuring device 150. The at least one temperature measuring device 150 may be configured to be inserted into and out of the biomass source 162 that is contained in one of the heating zones 116. For instance the at least one temperature measuring device 150 may be inserted into the biomass source 162 that has been moved into the first heating zone 116*a* to measure the temperature of the biomass source 162. Referring to FIG. 2, the temperature measuring device 150 is depicted above the reactor 102, such that the temperature device 150 may be inserted into the biomass source 162 within the reactor 102 from above. It will be appreciated that the temperature measuring device 150 may be inserted from other avenues, such as the bottom of the reactor 102. It is also appreciated that the temperature measuring device may be integrally placed with the reactor 102. The temperature measuring device 150 may be inserted while the biomass source 162 is stationary in the reactor 102, and the temperature measuring device 150 may be retracted away from the reactor 102 when the biomass source 162 is being moved by the entry mover 112 and/or the exit mover 114. In another example, the temperature of gas released from the biomass source 162 may be measured. The temperature of the gas released from the biomass source 162 may be measured at any point within the apparatus 100. For example, temperature of the released gas may be measured within the offtake pipe 122 by the at least one temperature measuring device 150 as the gas travels through the offtake system 120.

In some non-limiting embodiments or aspects, and with continued reference to FIG. 2, the apparatus 100 may include an offtake system 120. The offtake system 120 is configured to capture the released gas from the reactor 102 for further processing. The offtake system 120 may include a tunnel head 124 and an offtake pipe 122. The tunnel head 124 may be in fluid communication with the reactor 102. The tunnel head 124 may be placed on top of the reactor 102 such that gas produced in the one or more heating zones 116 of the reactor 102 may be captured. The tunnel head 124 may be configured to depressurize the gas captured from the reactor 102. The offtake pipe 122 may be in fluid communication with the tunnel head 124. Gas captured by the tunnel head 124 may flow into the offtake pipe 122.

In some non-limiting embodiments or aspects, and with continued reference to FIG. 2, the apparatus 100 may include a decanter system 130. The decanter system 130 may be configured to cool the collected gas and convert a portion of the collected gas into liquid form. The decanter system 130 may include a liquor pipe 132, a liquor spray 134, a decanter tank 136, and a liquor spray pump 138. The decanter tank 136 may be configured to receive liquefied gas within the offtake pipe 122 that is captured from the reactor 102. A portion of the offtake pipe 122 may be slanted to allow liquefied gas to flow into the decanter tank 136. The liquor spray pump 138 may be configured to pump liquor contained within the decanter tank 136 to flow within the liquor pipe 132. The liquor pipe 132 may be in fluid communication with the liquor spray 134. The liquor spray 134 may be placed within the offtake pipe 122 and configured to spray liquor contained in the decanter tank 136 into the offtake pipe 122. The sprayed liquor may cool the captured gas for the gas to liquefy and flow into the decanter tank 136.

In some non-limiting embodiments or aspects, and with continued reference to FIG. 2, the apparatus 100 may include a gas collection system 140. The gas collection system 140 may be configured to direct the collected gas from the reactor 102 for further use, such as fuel for the one or more heating elements 158 or storage. The gas collection system 140 may be included an exhauster pump 142, an exit gas pipe 144, and a gas main 146. The gas collection system 140 may be in fluid communication with the offtake system 120 and the reactor 102. The gas main 146 is in fluid communication with one or more heating elements 158 such that captured gas may be provided to the one or more heating elements 158 as fuel for heating the reactor 102. The exhauster pump 142 may be placed within the gas main 146. The exhauster pump 142 may force collected gas to flow into the one or more heating elements 158. The exit gas pipe 144 may facilitate flow of the collected gas away from the apparatus 100 for recycled use or storage. The exit gas pipe 144 may be placed within the decanter tank 136 as to facilitate flow of gas contained within the decanter tank 136 out of the apparatus 100. The exit gas pipe 144 may be placed within the offtake pipe 122 as to facilitate flow of gas contained within the offtake pipe 122 out of the apparatus 100.

Figure 3:
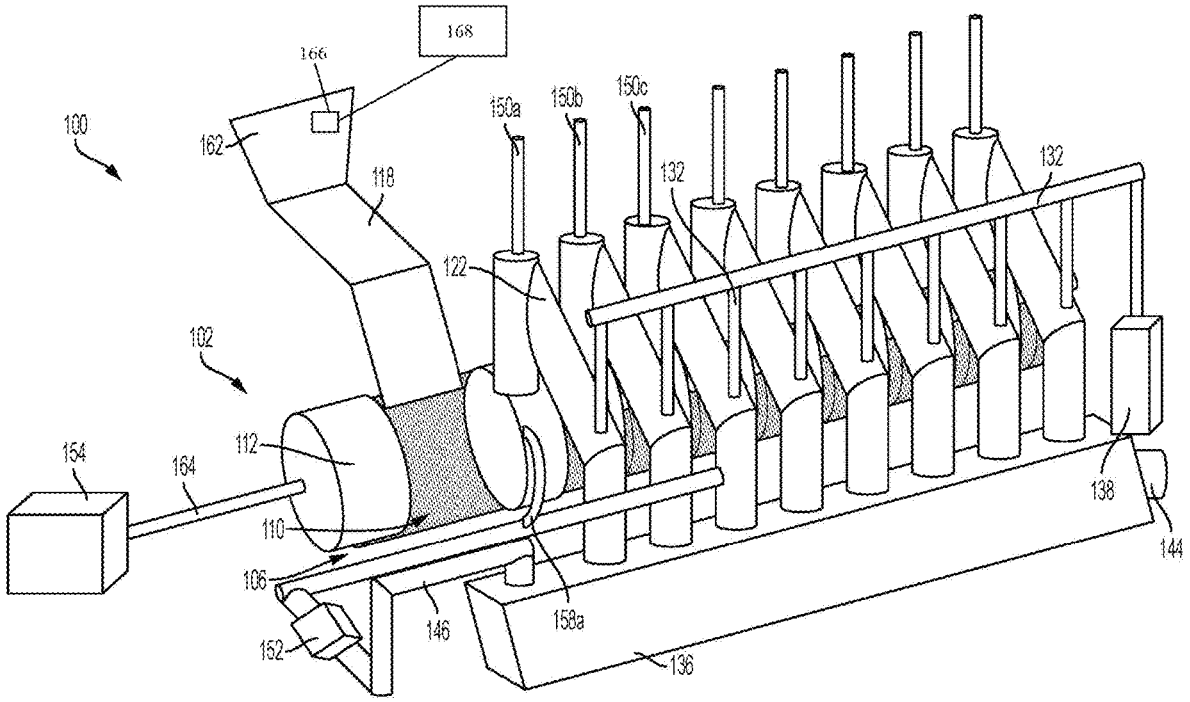
FIG. 3 is a schematic view of the biomass reactor of FIG. 1 with additional features according to non-limiting embodiments or aspects of the present disclosure.

In some non-limiting embodiments or aspects, and with reference to FIG. 3, the apparatus 100 is shown with a plurality of offtake systems 120, each of the plurality of offtake systems 120 corresponding to a heating zone 116. Each of the one or more heating elements 158 may correspond to one of the heating zones 116 of the reactor 102. Alternatively, one or more heating elements may correspond to each of the heating zones 116 of the reactor 102. A temperature measuring device 150 may be configured to measure temperature of the biomass source 162 placed in one of the heating zones 116. For example, a first temperature measuring device 150*a* may measure the temperature of the biomass source 162 placed within the first heating zone 116*a* that is heated by the first heating element 158*a*, a second temperature measuring device 150*b* may measure the temperature of the biomass source 162 placed within the second heating zone 116*b* that is heated by the second heating element 158*b*, and so on. In operation, a first portion of the biomass source 162 may be introduced into the load zone 110 from the loading chute 118. After the first portion of the biomass source 162 is introduced into the load zone 110, the loading chute 118 may close. The amount of the first portion of the biomass source 162 may be determined by the controller 168 depending on the quantity and composition of the first portion of the biomass source 162. One or more sensors 166 may determine the quantity and quality of the biomass source 162, such as weight, volume, composition, etc. The first portion of the biomass source 162 may be compacted by the entry mover 112 and/or the exit mover 114. Once compacted, the first portion of the biomass source 162 may be moved into the first heating zone 116*a* by the entry mover 112 and the exit mover 114 that move in unison. The first heating element 158*a* heats the first heating zone 116*a* of the reactor 102. While the first heating zone 116*a* is being heated, the first temperature measuring device 150 may be inserted into the first portion of the biomass 162 to measuring the temperature. The temperature data obtained by the temperature measuring device 150 may be communicated to the controller 168.

In some non-limiting embodiments or aspects, and with continued reference to FIG. 3, the controller 168 may determine that the first portion of the biomass mass 162 be moved into the second heating zone 116*a*. The controller 168 may determine the time and the temperature the first portion of the biomass source 162 should be heated in the first heating zone 116*a* depending on a plurality of factors, such as the quantity, volume of the biomass source 162, weight of the biomass source 162, composition of the biomass source 162, and the desired carbon product from the biomass source 162. After heating the first portion of the biomass source 162, the controller 168 may retract the first temperature measuring device 150*a* from the first portion of the biomass source 162. Then, the first biomass source 162 may be moved into the second heating zone 116*b*, in which the same process occurs with the second temperature measuring device 150*b* and the second heating element 158*b*, and so on until the first portion of the biomass source 162 exits the apparatus 100 via the exit opening 108. The end product of the biomass source 162 that exits via the exit opening 108 may be a solid carbon product. The resulting carbon product from the biomass source 162 may be further processed, such as compressed and cooled via dry methods, such as using liquid nitrogen. Alternatively, the solidified carbon product may be processed via wet dry methods. As the first portion of the biomass source 162 is being heated in the first heating zone 116*a*, the entry mover 112 move back to its initial position as to allow a second portion of the biomass source 162 to be introduced into the load zone 110. The load zone 110 for the second portion of the biomass source 162 is defined by the space between the entry mover 112 and the first portion of the biomass source 162 in the first heating zone 116*a*. The second portion of the biomass source 162 may be compacted by the entry mover 112 and/or the exit mover 114. Once the controller 168 determines that the first portion of the biomass source 162 will be moved into the second heating zone 116*b*, the entry mover 112 and the exit mover 114 move into unison as to move the second portion of the biomass source 162 into the first heating zone 116*a* and the first portion of the biomass source 162 into the second heating zone 116*b*. The same process repeats such that a third portion of the biomass source 162 may be introduced into the load zone 110 while the first and the second portions of the biomass source 162 are being heated in their respective heating zones 116. After heating and extracting products from the biomass source, the first, second, and third portions of the biomass source are moved into their next respective heating zones 116. This process repeats throughout a plurality of heating zones until the biomass source 162 exits the apparatus via the exit opening 108.

In some non-limiting embodiments or aspects, and with continued reference to FIG. 3, the apparatus 100 may include an offtake system 120 for each of the respective heating zones 116. For instance, a tunnel head 124 may be placed on top of each of the heating zones 116 as to collect gas that is produced by pyrolysis in the reactor 102. The decanter tank 136 may include an exit opening that may facilitate the flow of collected liquefied, or cooled, collected gas from the reactor 102 away from the apparatus 100 for further processing and/or recycled use. The liquefied carbon may be, but not limited to, tar.

Figure 4A:
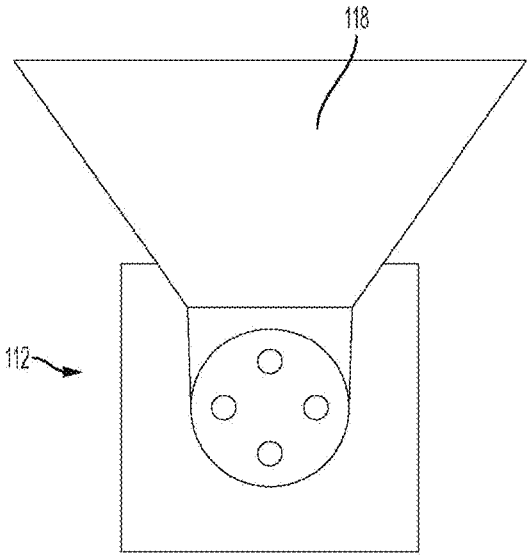
FIGS. 4A and 4B are a schematic view of a hydraulic unit according to non-limiting embodiments or aspects of the present disclosure.
Figure 4B:
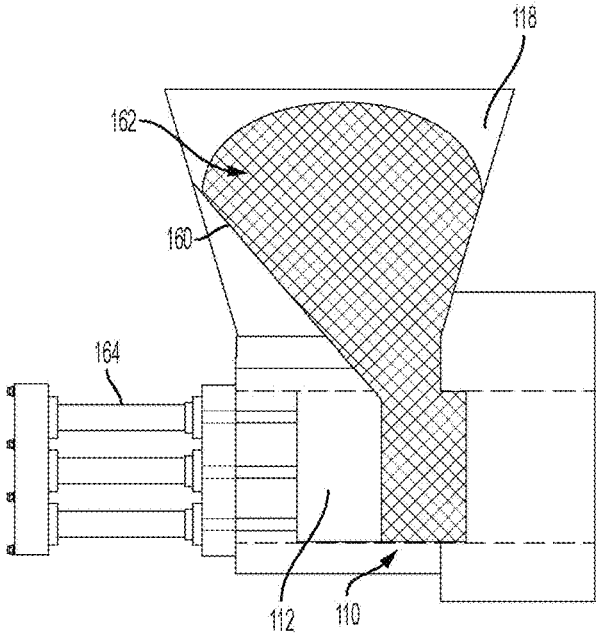

In some non-limiting embodiments or aspects, and with reference to FIGS. 4A and 4B, the entry hydraulic unit 154 is shown. It is appreciated that FIGS. 4A and 4B depicts the exit hydraulic unit 156. The entry hydraulic unit 154 may comprise one or more hydraulic cylinders 164. The one or more hydraulic cylinders 164 may extend away from the entry hydraulic unit 154 and retract towards the entry hydraulic unit 154. The one or more hydraulic cylinders 164 may be attached to the entry mover 112 as to move the entry mover 112 as the one or more hydraulic cylinders 164 move. The loading chute 118 may include a baffle plate 160 that facilitates the flow of the biomass source 162 into the load zone 110 of the reactor 102.

Although the disclosure has been described in detail for the propose of illustration based on what is currently considered to be practical and preferred embodiments, it is not to be understood that such detail is solely for that purpose and that the disclosure is not limited to the disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

The invention claimed is:

1. An apparatus for production of a carbon product from a biomass source, the apparatus comprising:

a reactor comprising a hollow body configured to receive the biomass source therein, the hollow body having a proximal end with an entry opening and a distal end with an exit opening, and a load zone between the proximal end and the distal end;

an entry mover at the proximal end of the hollow body and movable between the proximal end and the distal end;

an exit mover within the hollow body positioned distal to the entry mover; and at least one heating element, the at least one heating element configured to heat at least one heating zone of the hollow body, wherein the load zone is defined by a space within the hollow body between the entry mover and the exit mover, wherein the reactor continually receives the biomass source while the at least one heating element is heating a portion of the biomass source.

2. The apparatus of claim 1, further comprising an offtake system having at least one offtake pipe and at least one tunnel head, the offtake system configured to receive gas from the hollow body of the reactor.

3. The apparatus of claim 2, wherein the at least one tunnel head is configured to offtake gas produced during production of the carbon product from within the hollow body of the reactor.

4. The apparatus of claim 2, wherein the at least one offtake pipe is in fluid communication with the tunnel head, the at least one offtake pipe configured to receive gas from the tunnel head.

5. The apparatus of claim 1, further comprising a decanter system having at least one liquor pipe, at least one liquor spray, and a decanter tank, wherein the decanter system is configured to cool the gas received by an offtake system.

6. The apparatus of claim 5, wherein the at least one liquor pipe having a proximal end is in fluid communication with a decanter tank and a distal end in fluid communication with at least one offtake pipe.

7. The apparatus of claim 5, wherein the at least one liquor spray is connected to the proximal end of the at least one liquor pipe.

8. The apparatus of claim 5, wherein the at least one liquor spray is configured to spray liquor from the decanter tank into at least one offtake pipe.

9. The apparatus of claim 1, further comprising a gas collection system having at least one exhauster pump, at least one exit gas pipe, and at least one gas main.

10. The apparatus of claim 9, wherein the at least one exhauster pump facilitates gas flow from a decanter system into the at least one gas main, wherein the at least one gas main is in fluid communication with the at least one heating element.

11. The apparatus of claim 9, wherein the at least one exit gas pipe facilitates gas flow out from the decanter system and/or an offtake system.

12. The apparatus of claim 1, further comprising a loading chute configured to introduce the biomass source to the load zone.

13. The apparatus of claim 1, further comprising at least one temperature measuring device, the at least one temperature measuring device configured to measure temperature within the at least one heating zone.

14. The apparatus of claim 1, further comprising a shield surrounding the hollow body of the reactor and the at least one heating element.

15. The apparatus of claim 1, further comprising an entry hydraulic unit configured for moving the entry mover; and an exit hydraulic unit configured for moving the exit mover, wherein the entry mover and the exit mover move in unison within the hollow body of the reactor.

16. A method of producing a carbon product from a biomass source, the method comprising:

introducing a first load of the biomass source to a load zone of a reactor;

compacting the first load of the biomass source to a first predetermined size;

preheating a plurality of heating zones to a first predetermined temperature;

pushing the biomass source to a first heating zone of the plurality of heating zones;

heating the first heating zone of the plurality of heating zones to a second predetermined temperature;

introducing a second load of the biomass source to the load zone;

compacting the first load of the biomass source and the second load of the biomass source to a second predetermined size;

pushing the second load of the biomass source to the first heating zone and pushing the first load of the biomass source to a second heating zone of the plurality of heating zones; and heating the second heating zone to a third predetermined temperature.

17. The method of claim 16, further comprising measuring a temperature of the first load of the biomass source or the second load of the biomass source.

18. The method of claim 16, further comprising collecting gas generated from the biomass source from the plurality of heating zones.

19. The method of claim 17, further comprising cooling the gas collected from the plurality of heating zones; and collecting liquefied carbon from the collected gas, wherein the liquefied carbon comprises tar.

20. The method of claim 16, further comprising pushing the first load of the biomass source from the second heating zone of the plurality of heating zones to a collection zone; and treating the biomass source with nitrogen.

* * * * *